US008707632B2

(12) United States Patent
Forsland et al.

(10) Patent No.: US 8,707,632 B2
(45) **Date of Patent: *Apr. 29, 2014**

(54) STRUCTURE HAVING CONVERTIBLE ROOF AND WALLS

(75) Inventors: Kent H. Forsland, River Falls, WI (US); Mike Peters, West Bend, WI (US)

(73) Assignee: Cabrio Companies LLC, River Falls, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/561,774

(22) Filed: Jul. 30, 2012

(65) Prior Publication Data

US 2012/0291363 A1 Nov. 22, 2012

Related U.S. Application Data

(63) Continuation of application No. 12/875,833, filed on Sep. 3, 2010, now abandoned.

(60) Provisional application No. 61/240,020, filed on Sep. 4, 2009.

(51) Int. Cl.
*E04B 1/343* (2006.01)
*E04B 7/16* (2006.01)
*E04B 1/346* (2006.01)

(52) U.S. Cl.
USPC ..... 52/67; 52/64; 52/66; 52/72; 52/79.5; 4/494

(58) Field of Classification Search
USPC ..... 52/66, 67, 6, 64, 72, 79.5, 68, 69, 70, 52/71; 4/494
See application file for complete search history.

(56) References Cited

U.S. PATENT DOCUMENTS 5,591 A * 7/1829 Adams ..... 52/64
624,342 A * 5/1899 Kingsley ..... 52/200
1,006,374 A * 10/1911 Erb ..... 52/58

(Continued)

FOREIGN PATENT DOCUMENTS

DE 34 24 542 A1 1/1986
EP 147502 A1 * 7/1985

(Continued)

OTHER PUBLICATIONS

X-patent, pre-1836: US X0005591 11 to Adams, issued Jul. 29, 1829 (2 pages).*

(Continued)

*Primary Examiner* — Basil Katcheves
*Assistant Examiner* — Rodney Mintz
(74) *Attorney, Agent, or Firm* — Merchant & Gould P.C.

(57) ABSTRACT

A movable building structure is configured to selectively enclose an area. The structure includes at least one side wall and an end wall attached thereto. The side wall comprises a number of individual panels that are independently movable along a track secured to the ground. The panels are selectively collapsible such that they may travel along the track and overlap one another when in a collapsed or stowed position. The structure may be configured in any number of intermediate positions wherein the panels are partially collapsed. Roof panels may be attached to the side walls for movement therewith, or alternatively, the roof panels may operate independent of the side walls to extend and retract between an open and collapsed configuration.

17 Claims, 9 Drawing Sheets

(56) References Cited

U.S. PATENT DOCUMENTS

| | | | | | |
|---|---|---|---|---|---|
| 1,239,421 | A | * | 9/1917 | Metzger | 52/1 |
| 1,896,433 | A | | 2/1933 | August | |
| 2,094,801 | A | * | 10/1937 | Mass | 52/64 |
| 2,229,908 | A | | 1/1941 | Wenneborg | |
| 2,895,183 | A | | 7/1959 | Dumbolton | |
| 2,931,468 | A | * | 4/1960 | Keller | 428/46 |
| 3,028,872 | A | | 4/1962 | William | |
| 3,093,834 | A | | 6/1963 | Watkins | |
| 3,248,830 | A | | 5/1966 | Renouf | |
| 3,443,265 | A | | 5/1969 | Hauck | |
| 3,462,891 | A | | 8/1969 | Smith | |
| 3,552,072 | A | * | 1/1971 | O'Connell | 52/2.19 |
| 3,566,555 | A | | 3/1971 | Schultz et al. | |
| 3,589,084 | A | * | 6/1971 | Reed, III | 52/64 |
| 3,662,410 | A | | 5/1972 | Lankheet | |
| 3,766,691 | A | | 10/1973 | Ray | |
| 3,774,366 | A | * | 11/1973 | Baker | 52/664 |
| 3,845,591 | A | | 11/1974 | Stine | |
| 3,983,665 | A | * | 10/1976 | Burton | 52/71 |
| 4,009,796 | A | * | 3/1977 | Schmidt | 220/668 |
| 4,073,098 | A | * | 2/1978 | Baker | 52/66 |
| 4,175,361 | A | | 11/1979 | Kumode | |
| 4,245,614 | A | | 1/1981 | Hurwitz et al. | |
| 4,271,644 | A | | 6/1981 | Rilliet | |
| 4,283,889 | A | | 8/1981 | Dunn | |
| D261,037 | S | * | 9/1981 | Schlageter et al. | D25/22 |
| 4,312,157 | A | | 1/1982 | Hertel et al. | |
| 4,426,744 | A | | 1/1984 | Love | |
| 4,528,785 | A | * | 7/1985 | de Jager | 52/66 |
| 4,532,743 | A | | 8/1985 | Miller et al. | |
| 4,616,451 | A | * | 10/1986 | Glick | 52/66 |
| 4,633,626 | A | | 1/1987 | Freeman et al. | |
| 4,674,241 | A | | 6/1987 | Sarrazin | |
| 4,676,033 | A | * | 6/1987 | Allen et al. | 52/6 |
| 4,683,686 | A | | 8/1987 | Ozdemir | |
| 4,706,420 | A | | 11/1987 | Winkler | |
| 4,716,691 | A | * | 1/1988 | Allen et al. | 52/6 |
| 4,727,688 | A | * | 3/1988 | Kida et al. | 52/6 |
| 4,751,800 | A | * | 6/1988 | Kida et al. | 52/66 |
| 4,785,590 | A | | 11/1988 | Jones | |
| 4,807,312 | A | | 2/1989 | Baus | |
| 4,884,376 | A | | 12/1989 | DeBlock et al. | |
| 4,922,666 | A | * | 5/1990 | Rotter et al. | 52/66 |
| 4,942,698 | A | * | 7/1990 | Kumagai | 52/6 |
| 4,977,713 | A | | 12/1990 | Zveibil | |
| 5,026,109 | A | * | 6/1991 | Merlot, Jr. | 296/105 |
| 5,060,426 | A | * | 10/1991 | Jantzen | 52/86 |
| 5,063,730 | A | * | 11/1991 | Muramoto et al. | 56/66 |
| 5,156,195 | A | | 10/1992 | Wehler et al. | |
| 5,167,341 | A | * | 12/1992 | Morton et al. | 220/349 |
| 5,257,481 | A | * | 11/1993 | Reppas et al. | 52/6 |
| 5,293,728 | A | | 3/1994 | Christopher et al. | |
| 5,394,659 | A | * | 3/1995 | Kawaguchi et al. | 52/66 |
| 5,394,660 | A | | 3/1995 | Haris | |
| 5,596,844 | A | | 1/1997 | Kalinowski | |
| 5,598,665 | A | | 2/1997 | Guddas | |
| 5,655,335 | A | * | 8/1997 | Vermeer | 52/66 |
| 5,778,603 | A | * | 7/1998 | Reppas | 52/66 |
| 5,791,094 | A | * | 8/1998 | Thomson | 52/64 |
| 5,829,204 | A | * | 11/1998 | Lonnberg | 52/66 |
| 5,907,928 | A | | 6/1999 | Charbonnel | |
| 6,003,279 | A | | 12/1999 | Schneider | |
| 6,065,252 | A | * | 5/2000 | Norsen | 52/66 |
| 6,138,417 | A | * | 10/2000 | Woodard et al. | 52/64 |
| 6,145,254 | A | * | 11/2000 | Silva | 52/66 |
| 6,155,005 | A | * | 12/2000 | McNamara | 52/169.6 |
| 6,332,645 | B1 | | 12/2001 | Schwarz | |
| 6,430,879 | B1 | | 8/2002 | Nuiry et al. | |
| 6,474,027 | B2 | | 11/2002 | Nelson | |
| 6,591,557 | B1 | | 7/2003 | Thomsen et al. | |
| 6,604,327 | B1 | | 8/2003 | Reville | |
| 6,637,160 | B2 | | 10/2003 | Brooks | |
| 6,718,696 | B2 | * | 4/2004 | Silberman et al. | 52/6 |
| 6,851,227 | B1 | * | 2/2005 | Schildge, Jr. | 52/66 |
| 6,952,900 | B2 | * | 10/2005 | Leurent | 52/86 |
| 7,263,805 | B2 | | 9/2007 | Chapus | |
| 7,469,506 | B2 | | 12/2008 | Hosey | |
| 7,748,429 | B2 | | 7/2010 | Caire et al. | |
| 7,752,815 | B2 | | 7/2010 | Lauria et al. | |
| 7,762,900 | B2 | | 7/2010 | Henry et al. | |
| 8,136,306 | B2 | * | 3/2012 | Scheps | 52/67 |
| 8,209,937 | B2 | * | 7/2012 | Scheps | 52/747.1 |
| 8,215,066 | B2 | * | 7/2012 | Hosking et al. | 52/66 |
| 8,245,446 | B2 | * | 8/2012 | Betker | 49/199 |
| 8,322,084 | B2 | * | 12/2012 | Kestermann | 52/79.1 |
| 8,336,261 | B2 | * | 12/2012 | Hosking et al. | 52/66 |
| 8,381,452 | B1 | * | 2/2013 | Forsland et al. | 52/66 |
| 8,387,315 | B2 | * | 3/2013 | Hosking et al. | 52/66 |
| 8,397,440 | B1 | * | 3/2013 | Ceballos | 52/66 |
| 8,443,555 | B2 | * | 5/2013 | Chapus | 52/64 |
| 8,505,246 | B1 | * | 8/2013 | Cadorath | 52/79.6 |
| 8,511,001 | B2 | * | 8/2013 | Uffner et al. | 52/66 |
| 8,555,557 | B2 | * | 10/2013 | Hosking et al. | 52/66 |
| 8,590,214 | B2 | * | 11/2013 | Laprise et al. | 52/66 |
| 2002/0032993 | A1 | | 3/2002 | Nelson | |
| 2002/0134028 | A1 | * | 9/2002 | Silberman et al. | 52/6 |
| 2003/0000154 | A1 | | 1/2003 | Ignazio | |
| 2003/0014927 | A1 | | 1/2003 | Brooks | |
| 2004/0187397 | A1 | | 9/2004 | Chapus | |
| 2005/0235579 | A1 | * | 10/2005 | Hosey | 52/68 |
| 2006/0248807 | A1 | * | 11/2006 | Penna, IV | 52/64 |
| 2007/0051054 | A1 | * | 3/2007 | Devincenzo et al. | 52/72 |
| 2009/0107061 | A1 | | 4/2009 | Guthrie | |
| 2009/0300997 | A1 | | 12/2009 | Scheps | |
| 2010/0105282 | A1 | * | 4/2010 | Alazemi | 449/26 |
| 2011/0036021 | A1 | * | 2/2011 | Lonnberg | 52/64 |
| 2011/0271619 | A1 | * | 11/2011 | Nelson et al. | 52/243.1 |
| 2011/0308173 | A1 | * | 12/2011 | Forsland et al. | 52/67 |
| 2012/0000141 | A1 | | 1/2012 | Forsland et al. | |
| 2012/0031013 | A1 | * | 2/2012 | Scheps | 52/67 |
| 2012/0090250 | A1 | * | 4/2012 | Moscovitch | 52/68 |
| 2012/0131858 | A1 | * | 5/2012 | Hosking et al. | 52/6 |
| 2012/0131859 | A1 | * | 5/2012 | Hosking et al. | 52/6 |
| 2012/0131860 | A1 | * | 5/2012 | Hosking et al. | 52/8 |
| 2012/0131861 | A1 | * | 5/2012 | Hosking et al. | 52/8 |
| 2012/0279140 | A1 | * | 11/2012 | Silberman et al. | 52/64 |
| 2013/0042541 | A1 | * | 2/2013 | Forsland et al. | 52/66 |
| 2013/0305625 | A1 | * | 11/2013 | Pike et al. | 52/64 |
| 2013/0305627 | A1 | * | 11/2013 | Pike et al. | 52/79.5 |

FOREIGN PATENT DOCUMENTS

| | | | | |
|---|---|---|---|---|
| EP | 1793055 | A1 | * | 6/2007 |
| FR | 2 623 550 | A1 | | 5/1989 |
| FR | 2 866 379 | A1 | | 8/2005 |
| GB | 2 097 849 | A | | 11/1982 |
| GB | 2 135 372 | A | | 8/1984 |
| GB | 2400387 | A | * | 10/2004 |
| GB | 2 414 251 | A | | 11/2005 |
| JP | 04106253 | A | * | 4/1992 |
| JP | 4-203061 | | | 7/1992 |
| JP | 5-231071 | | | 9/1993 |
| JP | 08126438 | A | * | 5/1996 |
| JP | 11093263 | A | * | 4/1999 |
| JP | 2003-293457 | | | 10/2003 |
| JP | 2005083117 | A | * | 3/2005 |
| NL | 9500387 | | | 10/1996 |
| WO | WO 2013090429 | A1 | * | 6/2013 |

OTHER PUBLICATIONS

U.S. Appl. No. 13/043,162, filed Mar. 8, 2011 entitled "Flexible Space Technologies".

Brochure from Libart Enclosure Systems, 12 pages (Publicly known at least as early as Jan. 2009).

Brochure from Roll-A-Cover, International, 8 pages (Publicly known at least as early as Jan. 2009).

Images from www.libart.com website, 18 pages (Date Printed Jan. 25, 2011).

* cited by examiner

STRUCTURE HAVING CONVERTIBLE ROOF AND WALLS

CROSS-REFERENCE TO RELATED APPLICATIONS

This application is a Continuation of application Ser. No. 12/875,833, filed Sep. 3, 2010, which claims priority from U.S. Provisional Patent Application Ser. No. 61/240,020, filed on Sep. 4, 2009, the entirety of which is expressly incorporated by reference herein.

BACKGROUND

The present invention relates in general to the field of building structures. More particularly, the present invention relates to building structures that are selectively collapsible and/or movable. Specifically, a preferred embodiment of the present invention relates to a building structure configured to enclose an outdoor location wherein the structure is selectively collapsible for storage.

SUMMARY

By way of summary, the present invention is directed to a building structure that is configured for outdoor use. The structure according to the present invention preferably comprises an enclosure having a number of sides and a roof assembly extending upwardly from the sides. The sides of the structure are preferably supported on a number of rails attached to the ground. The sides of the structure are secured to the rails preferably by rollers or similar such members such that the sides are selectively movable along the rails. Each of the sides of the structure comprises a number of panels. The panels of the structure are configured to cooperate with the other panels of a particular side of the structure such that the panels may be selectively retracted so as to overlap one another and thereby collapse the structure for storage. Similarly, the roof of the structure comprises a number of roof panels that cooperate with one another such that they overlap one another when retracted. When the structure is in the closed position and the side panels and roof panels are retracted and overlap one another, a user may selectively extend the structure to a number of intermediate positions whereby the respective panels are extended to form an enclosure.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
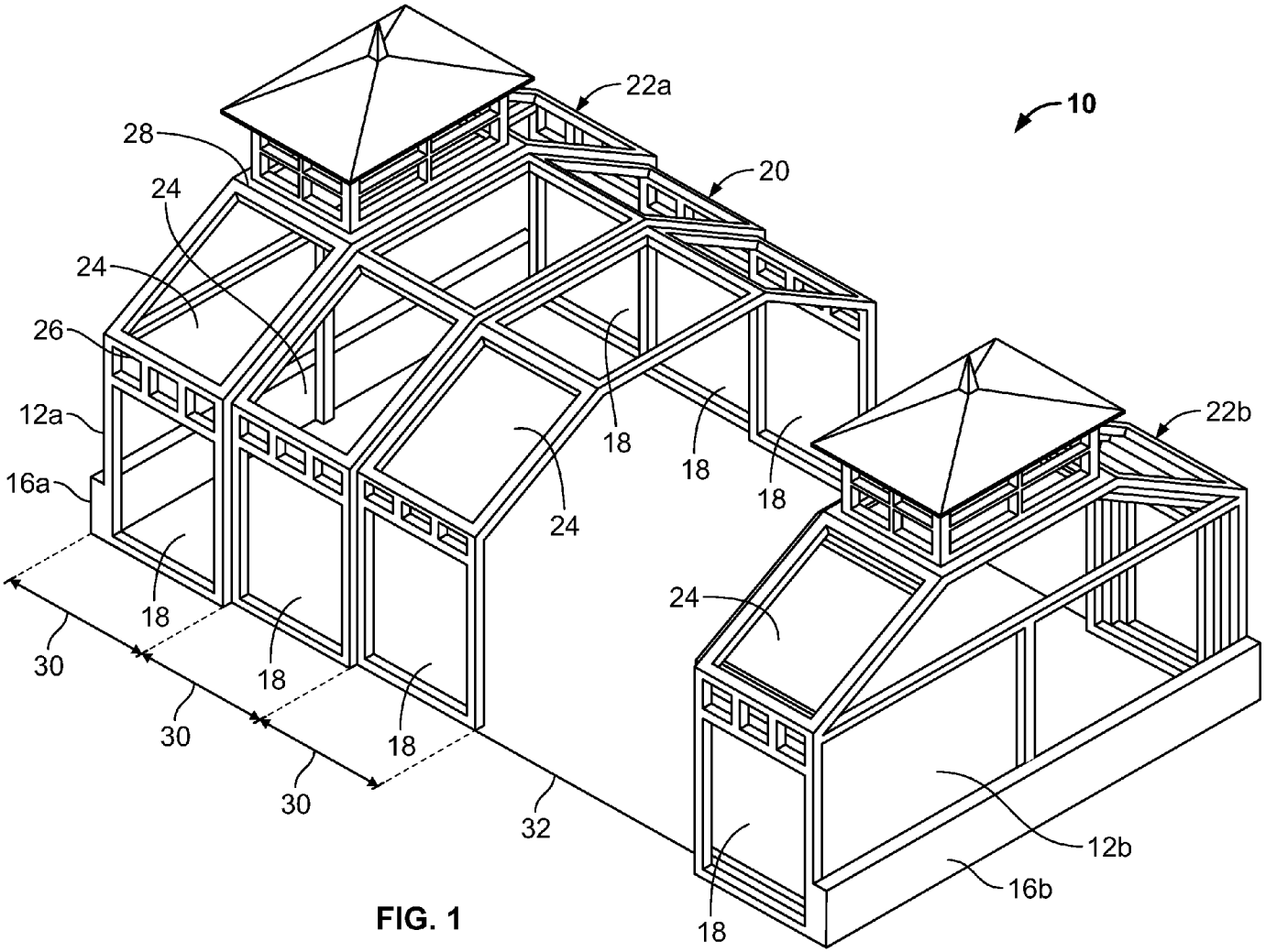
FIG. 1 is a perspective view of a first embodiment of a building structure according to the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected", "attached", or terms similar thereto are often used. They are not limited to direct connection but include connection through other elements where such connection is recognized as being equivalent by those skilled in the art.

DETAILED DESCRIPTION

Referring now to the drawings, and initially to FIG. 1, a representative embodiment of a building structure 10 according to the present invention is illustrated. The structure 10 is configured to selectively enclose a particular area such that the area enclosed may be protected from the environment, i.e., hot or cold weather, rain, snow, etc. Alternatively, the structure 10 may be arranged such that the area enclosed is completely or partially exposed to the elements as desired.

The structure 10 preferably includes two ends 12*a*, 12*b* and a pair of sides 14*a*, 14*b*. Ends 12*a*, 12*b* are fixed in place and fixed to a pair of walls 16*a*, 16*b*, respectively. Walls 16*a*, 16*b* may be constructed from any suitable material including brick, concrete, wood, and the like. Sides 14*a*, 14*b* may include a number of independent side panels 18. Structure 10 includes a roof 20 preferably comprising a pair of pitched roof members 22*a*, 22*b*. Roof 20 is preferably angled as opposed to flat as is generally understood in the art. The angled roof prevents water, snow, debris, etc. from settling on the roof and thereby providing a relatively improved aesthetic appearance. Also, the angled roof 20 prevents the retention of debris on the roof 20 that may be capable of interfering with the operation of the structure 10 as will be explained in detail herein. Roof 20 is preferably constructed from a relatively lightweight material to facilitate movement thereof.

The roof members 22*a*, 22*b* include a number of independent roof panels 24 that are individually coupled to one of each of the side panels 18. Accordingly, side panels 18 and roof panels 24 cooperate to form an enclosure wherein the panels extend vertically from a ground surface. At an upper end of each of side panels 18, the side panels 18 are attached to a corresponding roof panel 24 which is pitched so as to form a half of roof 20. Roof panel 24 is attached to side panel 18 at a first end 26. Roof panel 24 includes a second end 28 that is attached to a corresponding second end of an adjacent roof panel 24. Adjacent roof panel 24 likewise includes a first end 26 coupled to an upper portion of a side panel 18 to form one segment 30 of structure 10. Side panels 18 and roof panels 24 may be constructed from any number of materials and may be opaque, tinted, or clear. The side panels 18 and roof panels 24 may be selectively and individually openable by any number of known mechanisms. The side panels 18 and roof panels 24 may be constructed from a number of different materials including plastic and glass. Further, the side panels and roof panels may be tinted to provide a user of the structure with enhanced privacy.

Side panels 18 are secured at a lower end thereof to a track 32 attached to the ground. Track 32 may comprise any type of rail as is generally understood in the art. The lower ends of side panels 18 are configured to cooperate with the track 32 to ride therealong as will be described in detail herein. Lower side panels 18 may comprise any known method of cooperating with and riding along tracks 32 for movement thereon. Preferably, tracks 32 are configured such that the side panels 18 and roof panels 24 may be moved toward one or both of the ends 12*a*, 12*b* in an overlapping fashion such that structure 10 is collapsible or may otherwise be configured for storage thereof. Side panels 18 and roof panels 24 may slide either under or over the fixed end.

Thus, in operation, a user may selectively retract segments 30 of structure 10 as illustrated at end 12*b* of FIG. 1. Segments 30 may be coupled to a power source or may otherwise be manually movable along tracks 32. As desired, the user of structure 10 may slide one of segments 30 toward either of ends 12*a*, 12*b* such that each segment 30 overlaps the subsequent segments such that structure 10 may be compactly stored in a stowed position as shown at 12*b*. Alternatively, a user may extend each of segments 30 so as to form a completed enclosure similar to that seen at end 12*a*. Numerous configurations of the structure 10 are contemplated. That is, only part of structure 10 may be in the fully retracted position whereas the remaining part of the structure 10 may be in a fully open position as shown in FIG. 1, or, alternatively, both ends 12*a*, 12*b* may be fully extended to form a complete enclosure or they may be fully retracted so as to collapse the structure 10 completely. Alternatively, the structure 10 may be configured such that one or both ends of the structure 10 are only partially retracted. Structure 10 may be configured such that it is retracted into, or in coordination with, another structure such as a garage or pool house.

In an alternative embodiment, the side panels 18 and roof panels 24 of structure 10 may operate independent of one another. In the present embodiment, structure 10 includes a pair of tracks 32*a*, 32*b*. Track 32*a* is fixed to the ground as in the previous embodiment and configured to allow for the movement of the side panels 18 along the track 32*a* as previously discussed. Track 32*b* is preferably positioned between an upper end of the side panels 18 and a lower end of the roof panels 24. Roof panels 24 are secured to track 32*b* and configured for travel along the track 32*b* similar to the manner in which the side panels 18 travel along track 32*a*. Each of tracks 32*a*, 32*b* is independently controllable such that the side panels 18 and roof panels 24 may move independent of one another.

Figure 2:
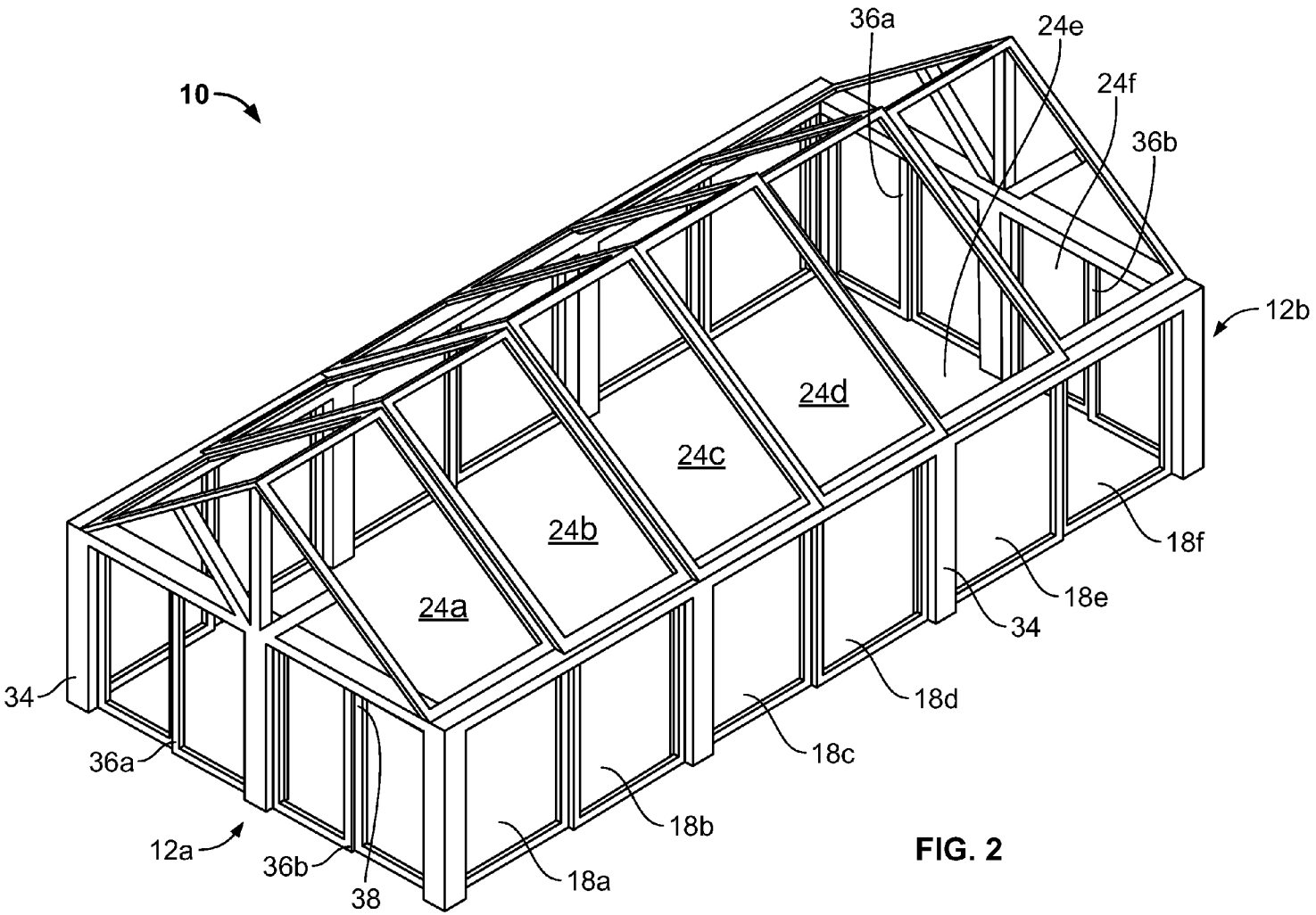
FIG. 2 is a perspective view of another embodiment of the structure according to the present invention.

Referring now to FIG. 2, a first alternative embodiment of the present invention is illustrated. Structure 10, as shown, includes a number of spaced supports 34 configured to cooperate with the side panels 18 of the present embodiment. In the embodiment illustrated in FIG. 2, side panels 18 and roof panels 24 are not joined to one another, but rather, the side panels 18 and roof panels 24 are independently retractable and extendable. In addition, structure 10 includes two pairs of end panels 36*a*, 36*b* on each end 12*a*, 12*b*. In operation, the present embodiment preferably includes three pairs of side panels 18 on either of the sides 14*a*, 14*b*. Side panels 18*a*, 18*b* are nearest end 12*a*, side panels 18*c*, 18*d* are positioned between ends 12*a*, 12*b* and side panels 18*e*, 18*f* are positioned nearest end 12*b*. Side panels 18*a*, 18*b*, and 18*c* are configured to be selectively retractable such that side panel 18*b* may be moved along tracks 32 so as to overlap side panel 18*a*. Side panel 18*c* is configured to move along tracks 32 to overlap side panels 18*a* and 18*b* to thereby partially collapse the structure and open the structure 10 for ingress and egress between an area outside and an area inside the structure 10. Similarly, side panel 18*e* is configured to ride along tracks 32 to overlap 18*f* and side panel 18*d* is configured to ride along tracks 32 to overlap side panels 18*e* and 18*f*. Each of the side panels 18*a*-18*f* of the present embodiment is independently openable and closeable for use as a door to allow for ingress and egress. Like side panels 18*a*-18*f*, roof panels 24*a*-24*f* are configured to ride along a roof rail 38 such that roof panel 24*c* overlaps roof panel 24*b* and roof panel 24*a* to thereby open the roof 20 of the structure 10. Similarly, roof panel 24*d* is configured to ride along roof rail 38 to overlap roof panels 24*e* and 24*f*. As with the previous embodiment of the present invention, roof panels 24 and side panels 18 are configured such that they may be individually pivoted between an open and closed position. Further, side panels 18 and roof panels 24 are configured such that they may be partially retracted such that structure 10 partially encloses the area.

Figure 3:
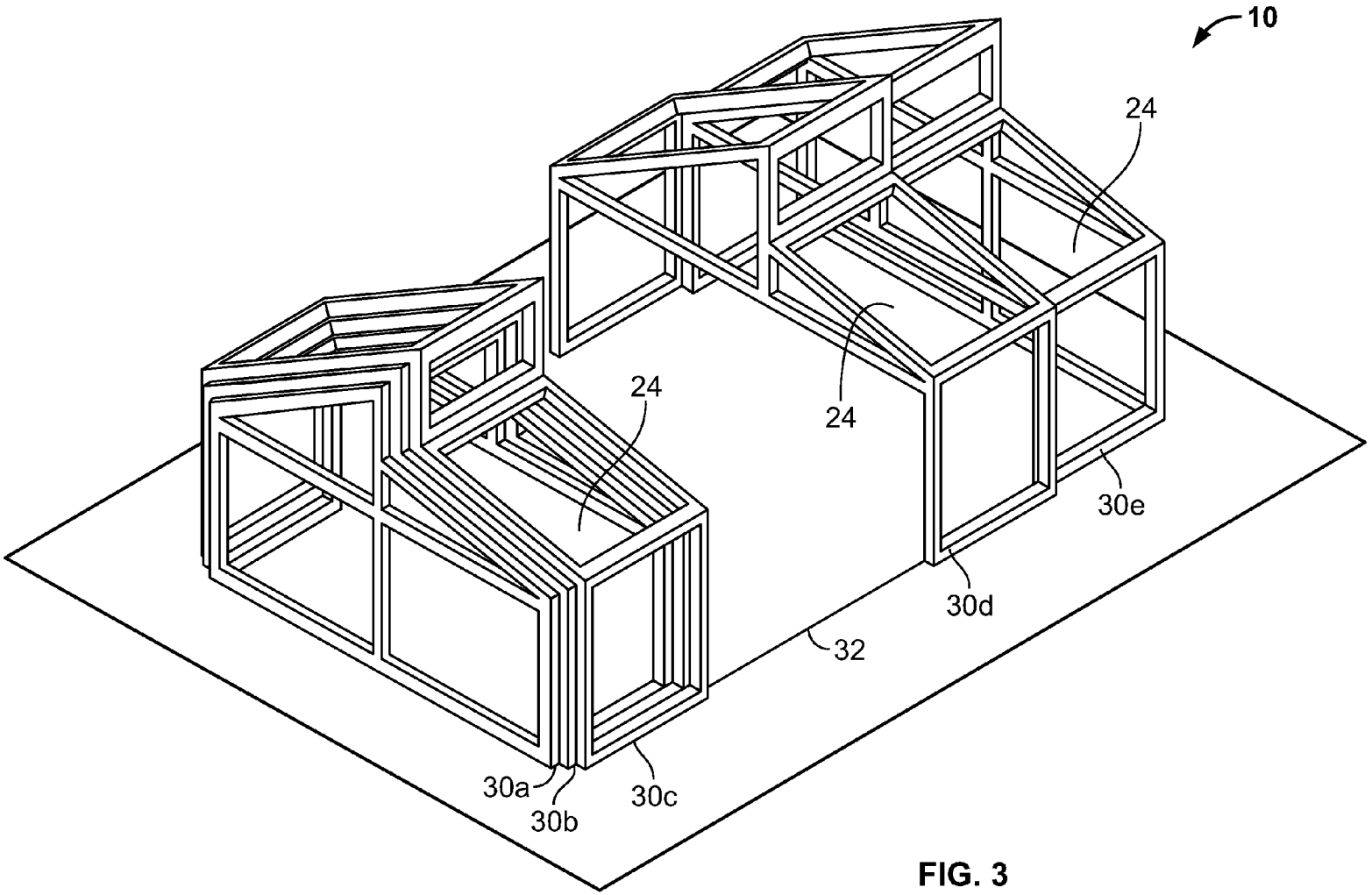
FIG. 3 is a perspective view of another embodiment of the structure according to the present invention.

Referring now to FIG. 3, another alternative embodiment of structure 10 according the present invention is illustrated. Structure 10 includes segments 30*a*-30*e*, which are configured to ride along the track 32 secured to the ground. As illustrated, segments 30*b*-30*c* are configured to independently ride along the track 32 to successively overlap one another to thereby collapse the structure 10. The segments 30*a*-30*e* may be arranged in any number of intermediate positions as well as being fully extended to fully enclose the structure's inner area or fully retracted to completely open the area to the elements. As with previous embodiments, the individual side panels 18 and roof panels 24 are selectively openable to expose the area surrounded by the structure 10 to the elements.

Figure 4:
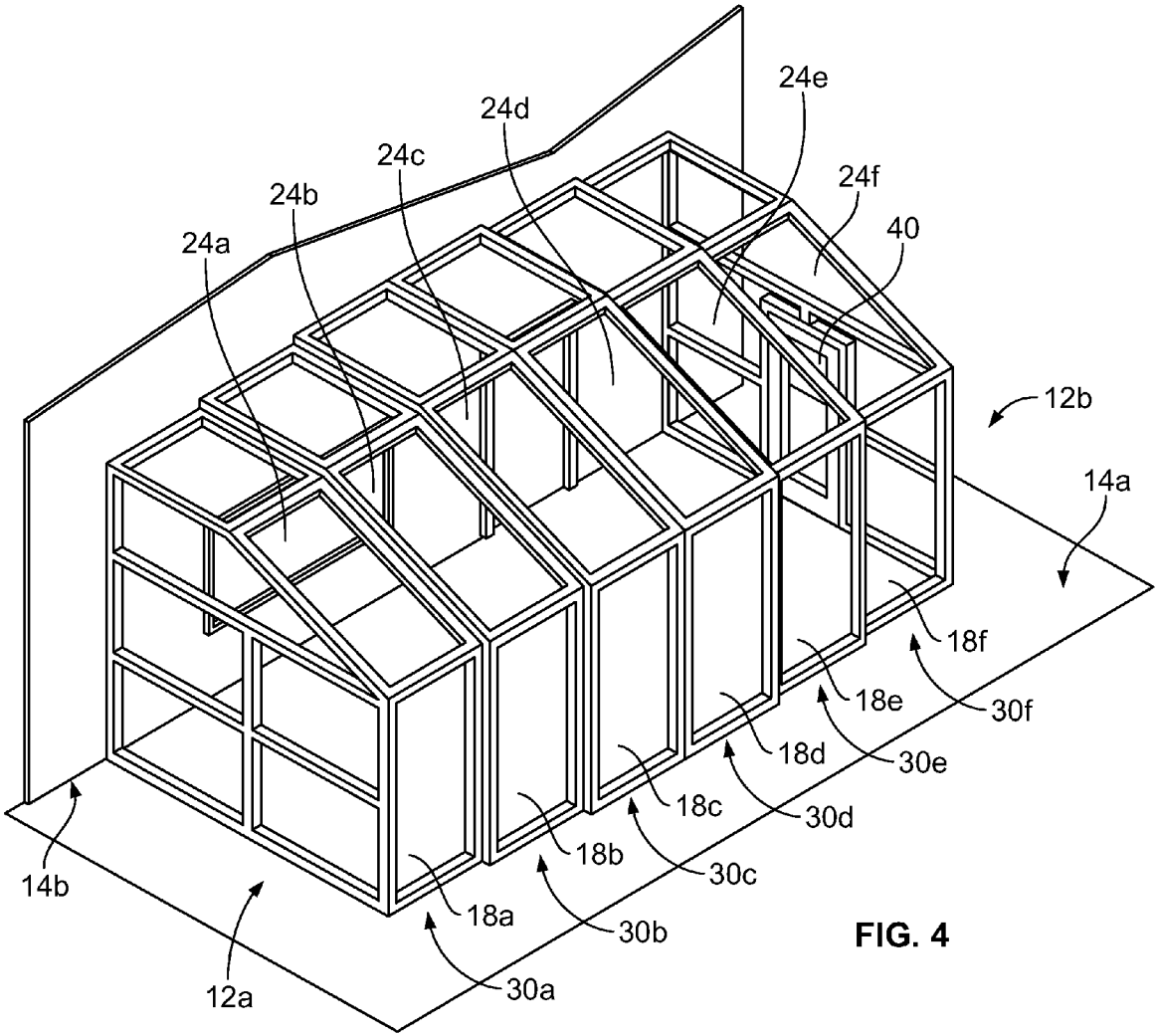
FIG. 4 is a perspective view of yet another embodiment of the structure according to the present invention.

Referring now to FIG. 4, yet another embodiment of the structure 10 according to the present invention is illustrated. The structure 10 of the present embodiment operates similarly to the structures 10 of the previous embodiments. Each of the roof panels 24*a*-24*f* is independently openable to expose a portion of the area surrounded by the structure 10 to the elements. For example, as shown, roof panel 24*e* is shown in the open position. In the illustrated embodiment, structure 10 includes a standard door 40 at one end 12*b* thereof for ingress and egress to the area surrounded by the structure 10. The structure 10 of the present embodiment is configured such that only one side 14*a* of the structure is supported on tracks 32 for extension and retraction thereof. Thus, side 14*b* is fixed in place. Therefore, when desired, segments 30*a*-30*f* are configured to be selectively moved along the rails for collapsing the structure 10 or extending it to enclose the inner area of the structure.

Figure 5A:
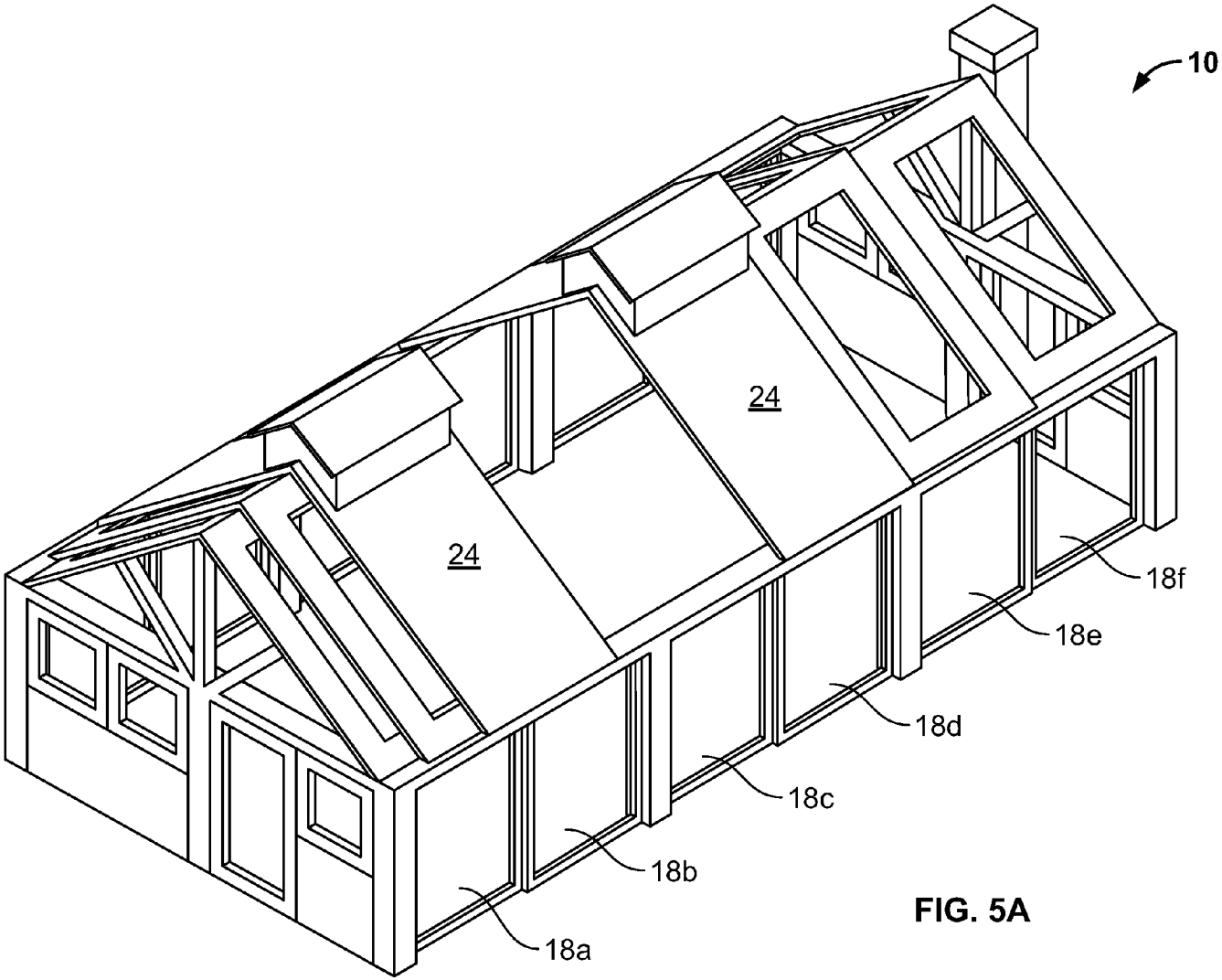
FIGS. 5*a*-5*b* are perspective views of still another embodiment of the structure according to the present invention.
Figure 5B:
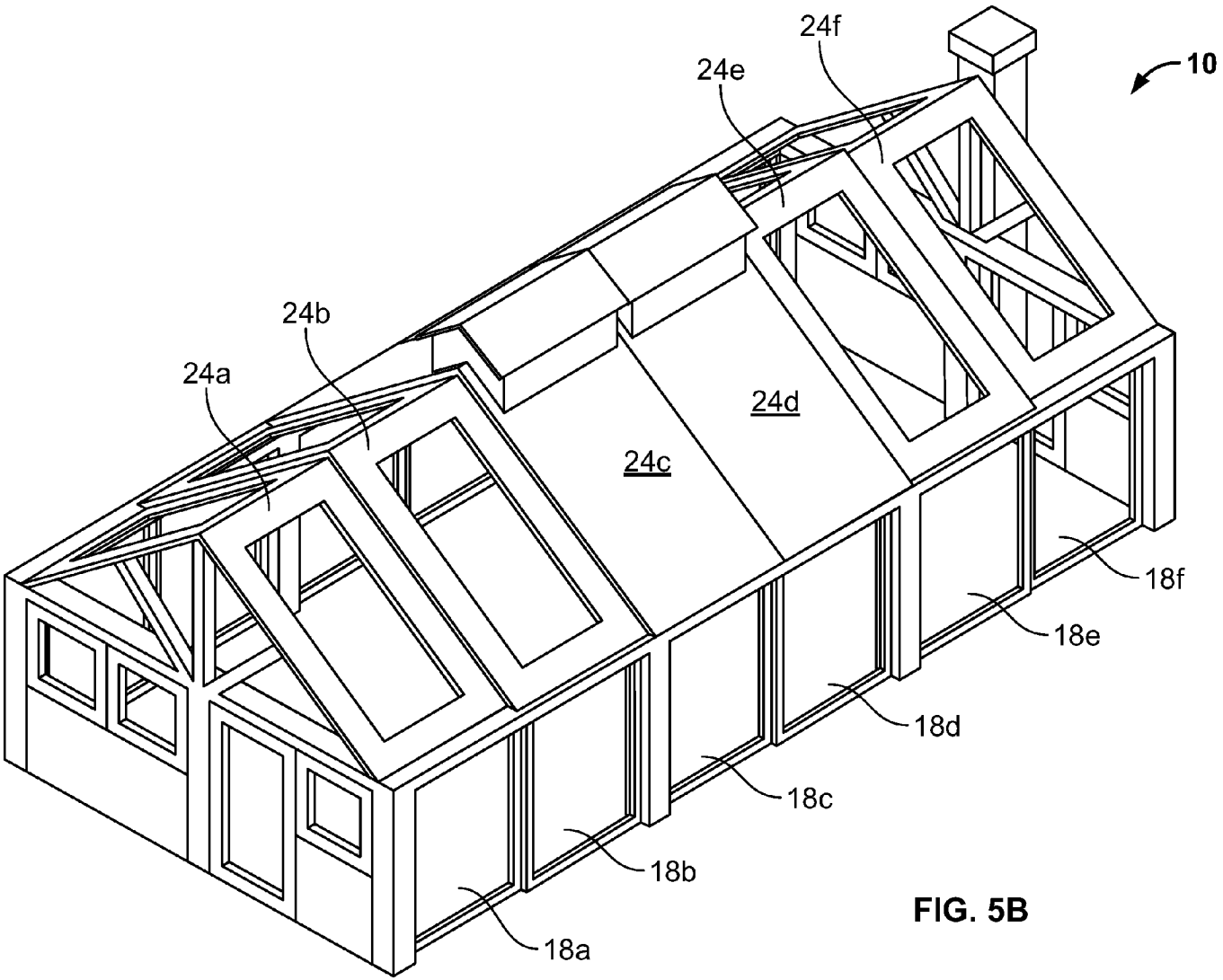

Turning now to FIGS. 5*a*-5*b*, another embodiment of the structure 10 according to the present invention is illustrated. The present embodiment operates similarly to the previous embodiments of the present invention. As shown in FIG. 5*a*, the roof panels 24 are independently configured for selective retraction and extension to move between open and collapsed configurations. Further, each of roof panels 24 is individually openable to expose the area surrounded by the structure 10 to the elements, as desired. Likewise, the side panels 18 are independently openable and collapsible. Accordingly, the roof panels 24 may be closed and the side panels 18 open or vice versa.

Figure 6B:
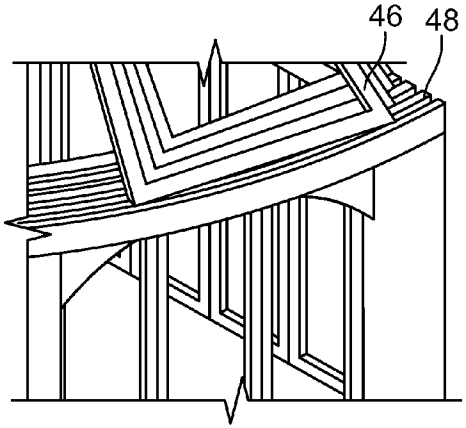
FIG. 6*b* is a partial elevation view of a portion of the structure of FIG. 6*a;*
Figure 6A:
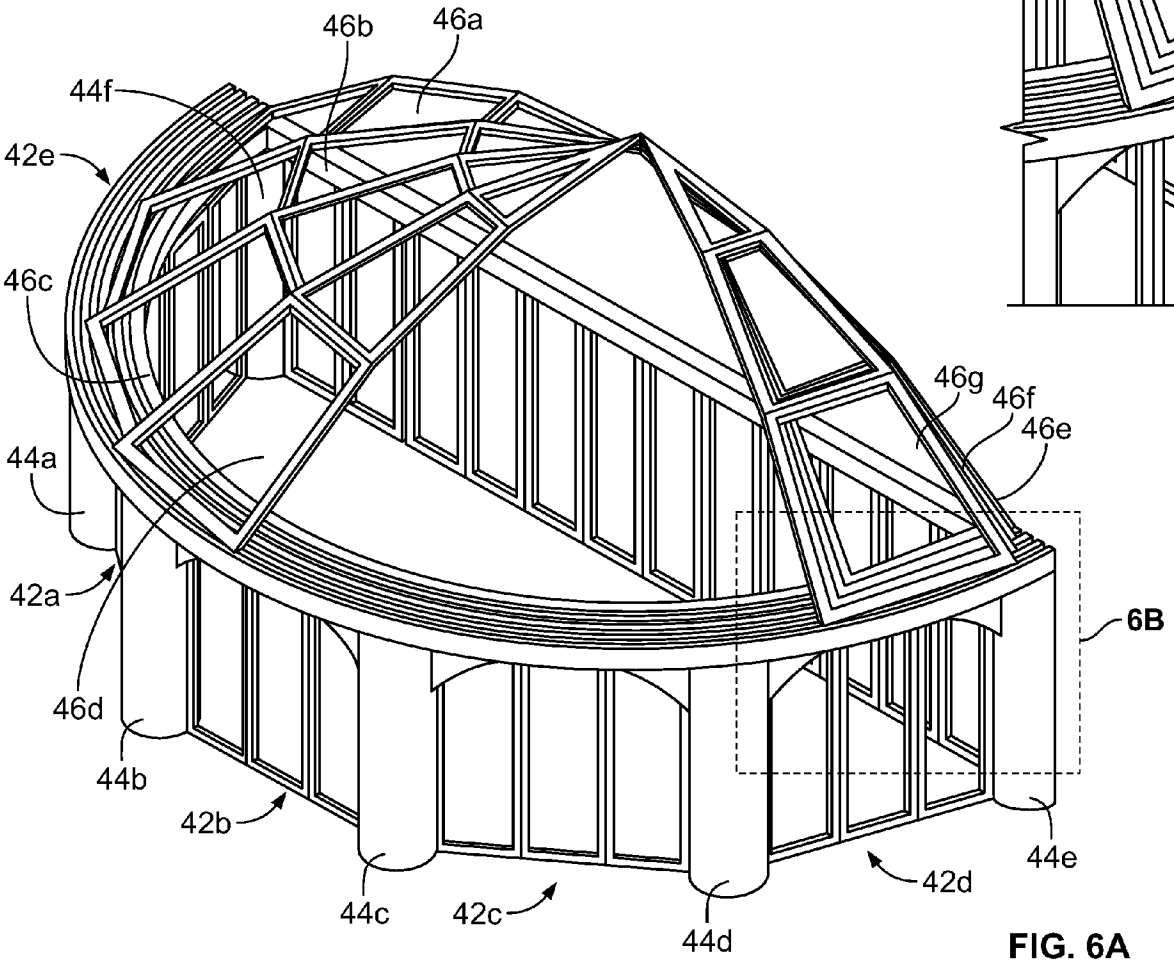
FIG. 6*a* is a perspective view of another embodiment of the structure of the present invention.

Referring now to FIGS. 6*a*-6*b*, an alternative embodiment of the structure 10 according to the present invention is illustrated. In the present embodiment, the structure 10 includes sides 42*a*-42*e* supported by supports 44*a*-44*f*. The sides may be selectively opened for ingress and egress between the outside and inside of the structure 10. The structure 10 further includes a roof having roof panels 46*a*-*g*, which may be opened and closed as shown. In the present embodiment, roof panels 46*a*-*g* open and close in a fan-like manner. The roof panels 46*a*-*g* are supported on a rail 48 that is secured between roof panels 46*a*-*g* and sides 42*a*-*e* such that the roof panels 46*a*-*g* are independently movable along the rail 48 to overlap one another. As with the previous embodiments, the roof panels 46*a*-*g* of the structure 10 may be positioned to be fully opened, closed, or any number of positions therebetween, as is generally understood. Referring now to FIG. 6*b* in particular, the roof panels 46 and track 48 are shown in close-up detail.

Figure 7:
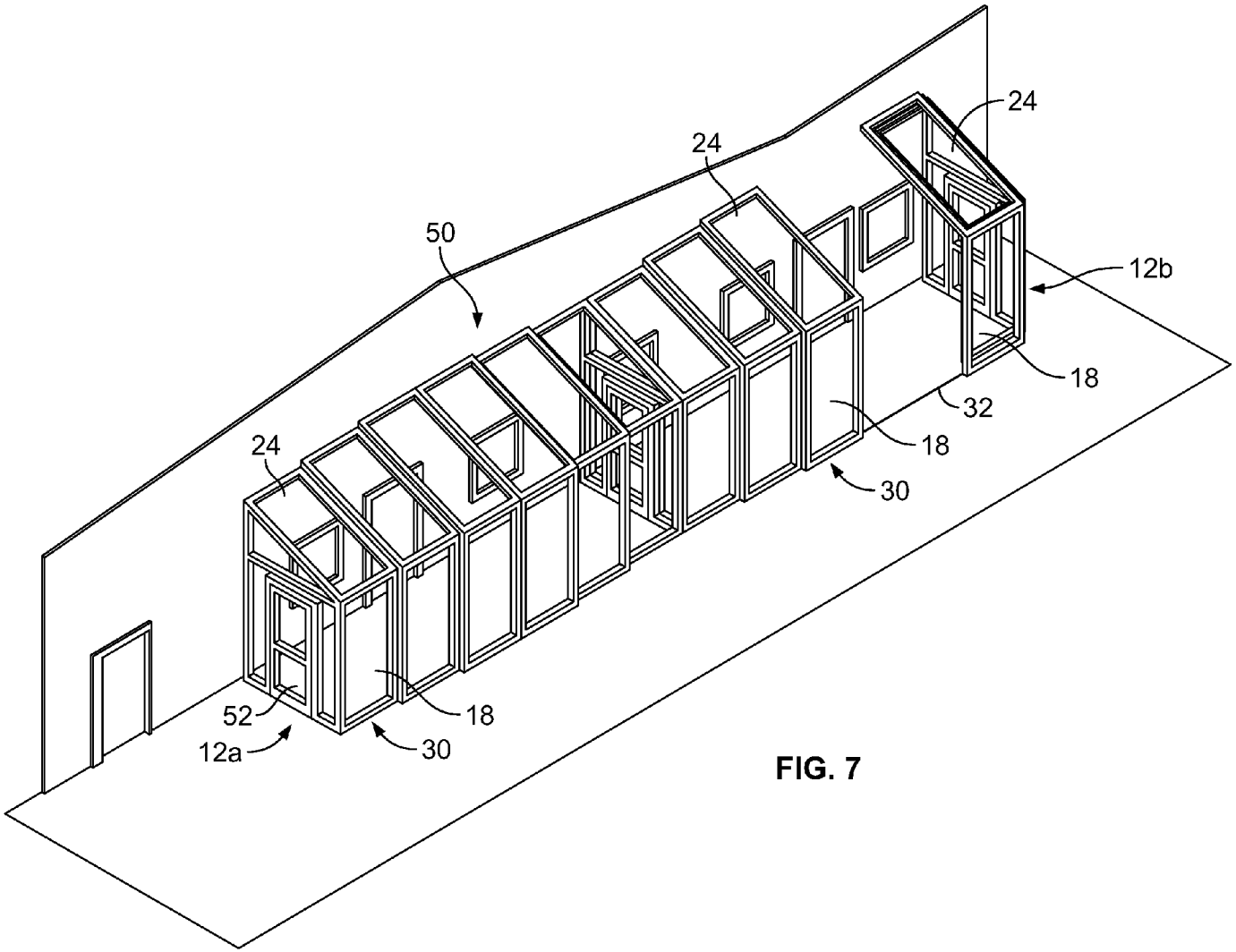
FIG. 7 is a perspective view of yet another embodiment of the structure of the present invention wherein the structure is attached to the exterior of a building.
Figure 8:
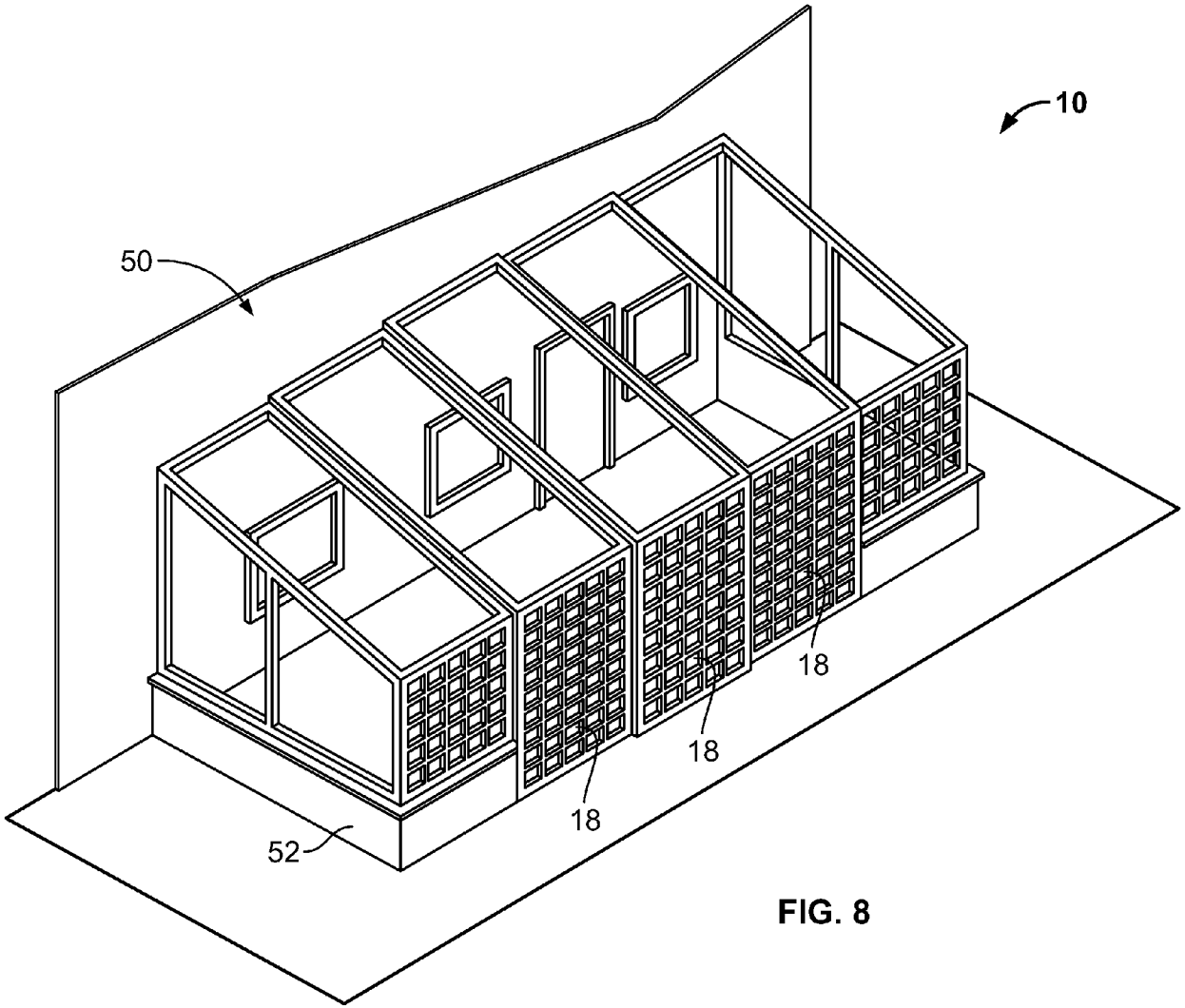
FIG. 8 is a perspective view of another embodiment of the structure of the present invention wherein the structure is built into an exterior of a building.

Turning now to FIGS. 7 and 8, another embodiment of the present invention is illustrated. As shown in FIGS. 7 and 8, structure 10 may be attached to the exterior of a restaurant, showroom, or similar such building 50. The present embodiment of the structure 10 operates similarly to the embodiments illustrated in FIGS. 1-5. Referring initially to FIG. 7, the structure 10 comprises a number of segments 30. Each of the segments 30 includes a side panel 18 and a roof panel 24 coupled to one another. Segments 30 are coupled to a track 32 as in the previous embodiments. Track 32 is secured to the ground, as is generally understood. End 12*a* of the structure 10 includes an exit door 52 for ingress and egress between the inside and outside of the structure 10. The structure of the present embodiment is configured such that each of the segments 30 is independently movable along the track 32. This allows the segments 30 to be movable between an extended position wherein the structure 10 fully encloses an area and a collapsed position wherein the area is completely open and the structure 10 is entirely moved along the track 32 to end 12*b*. As with the previous embodiments, the structure 10 may be positioned in any number of intermediate positions such that only a portion of the segments 30 is extended. Thus, the area enclosed by the structure 10 is user definable.

Now turning to FIG. 8, the structure 10 is attached to the exterior of a building 50 at one side thereof. In the present embodiment, the structure 10 is built into the building itself and cooperates with the exterior 52 thereof. As with the previous embodiments of the present invention, each of the side panels 18 is independently extendible in an open position and collapsible such that they overlap one another.

It is understood that a number of modifications may be made in keeping with the spirit of the structure 10 of the present invention. For example, the structure 10 may include a retracting screening system (not shown). The retracting screening system is preferably independently operable with respect to the side panels 18 and roof panels 24. The retracting screening system operates similarly to the side panels 18 and roof panels. Preferably, the retracting screening system is selectively movable from a deployed position and a collapsed position as well as a plurality of intermediate positions therebetween. As such, the operator of structure 10 may selectively screen in the area while collapsing the side panels 18 and roof panels 24 such that the area is open to the environment while keeping out insects and animals while maintaining a relatively private enclosure.

Further, structure 10 may be fitted with another independent auxiliary track (not shown). The auxiliary track is preferably configured for selectively moving objects within the area enclosed by structure 10. For example, the furniture, i.e., tables, seats, etc. may be coupled to the auxiliary track for movement along the track. As such, the positioning of the furniture within the structure 10 may be easily and selectively configured.

It is specifically intended that the present invention not be limited to the embodiments and illustrations contained herein, but include modified forms of those embodiments including portions of the embodiments and combinations of elements of different embodiments as come within the scope of the following claims.

The invention claimed is:

1. A building structure comprising:

a fixed structural frame including a header extending horizontally, the fixed structural frame defining an enclosable region having a perimeter defined by a first dimension and a second dimension, the enclosable region including a first side separated from a second side by the first dimension of the enclosable region, the enclosable region also having a third side that extends along the first dimension of the enclosable region between the first and second sides, the first and second sides extending along the second dimension of the enclosable region;

a convertible roof including a plurality of roof sections that are mounted on the header of the fixed structural frame above head level and that each span the second dimension of the enclosable region, the plurality of roof sections including movable roof sections that are mounted on the header of the structural frame and movable along the first dimension relative to the header of the fixed structural frame, the convertible roof being convertible between an open configuration and a closed configuration, the movable roof sections being movable relative to the header of the fixed structural frame along the first dimension to convert the convertible roof between the open configuration and the closed configuration, the roof sections substantially overlapping one another when the convertible roof is in the open configuration; and a side wall provided at the third side of the enclosable region, the side wall being configurable between an open configuration and a closed configuration, the side wall including a plurality of side wall sections, the plurality of side wall sections including movable side wall sections that are movable relative to the header of the fixed structural frame along the first dimension, the movable side wall sections being movable along the first dimension independent of all the roof sections, the movable side wall sections being movable relative to the header of the fixed structural frame along the first dimension to move the side wall between the open configuration and the closed configuration, a substantial portion of the side wall being open when the side wall is in the open configuration, and the movable side wall sections each having a height that extends to the header of the fixed structural frame on which the roof sections are supported.

2. The building structure of claim 1, wherein the heights of the movable side wall sections extend from a ground surface to the header.

3. The building structure of claim 1, wherein the side wall sections include separate side panels that move relative to one another.

4. The building structure of claim 1, wherein each of the roof sections includes a peak and first and second panel portions on opposite sides of the peak that pitch away from the peak.

5. The building structure of claim 4, wherein the roof sections nest when the convertible roof is in the open configuration.

6. The building structure of claim 1, wherein the roof sections include a first set that covers a first half of the first dimension of the enclosable region and a second set that covers a second half of the first dimension of the enclosable region, wherein the first set of roof sections stack adjacent the first end of the enclosable region when the convertible roof is in the open configuration, and wherein the second set of roof sections stack adjacent the second end of the enclosable region when the convertible roof is in the open configuration.

7. The building structure of claim 6, wherein the first and second sets of roof sections each includes at least three of the roof sections.

8. The building structure of claim 7, wherein each of the roof sections includes a peak at an intermediate location along a width of the fixed structural frame.

9. The building structure of claim 1, wherein each of the roof sections includes a peak at an intermediate location along the second dimension of the fixed structural frame.

10. The building structure of claim 9, wherein each roof section includes first and second panels positioned on opposite sides of the peak.

11. The building structure of claim 10, wherein the panels are transparent.

12. The building structure of claim 10, wherein the first and second panels are oriented at different angles relative to horizontal.

13. The building structure of claim 10, wherein the first and second panels are oriented at the same pitch angles relative to horizontal.

14. The building structure of claim 10, wherein the roof sections include panels positioned on opposite sides of the peak, and wherein a first plurality roof sections include transparent panels and a second plurality of roof sections include opaque panels.

15. The building structure of claim 1, wherein at least about a majority of the side wall at the third side of the enclosable region is open when the side wall is in the open configuration.

16. The building structure of claim 15, wherein at least a majority of an area over the enclosable region is open when the convertible roof is in the open configuration.

17. A building structure comprising:

a fixed structural frame defining an enclosable region having a perimeter defined by a length and a width, the enclosable region including a first end separated from a second end by the length of the enclosable region, the enclosable region also having a side that extends along the length of the enclosable region between the first and second ends;

the fixed structural frame including a header extending horizontally above head level along the length of the enclosable region;

a convertible roof including a plurality of roof sections that are mounted on the header of the fixed structural frame above head level and that each span the width the enclosable region, the plurality of roof sections including movable roof sections that are mounted on the header of the fixed structural frame and movable along a first orientation relative to the header of the fixed structural frame, the first orientation extending along the length of the fixed structural frame, the convertible roof being convertible between an open configuration and a closed configuration, the movable roof sections being movable relative to the header of the fixed structural frame along the first orientation to convert the convertible roof between the open configuration and the closed configuration, the roof sections substantially overlapping one another when the convertible roof is in the open configuration;

a convertible side wall provided at the side of the enclosable region, the convertible side wall being convertible between an open configuration and a closed configuration, the convertible side wall including a plurality of side wall sections, the plurality of side wall sections including movable side wall sections that are movable relative to the header of the fixed structural frame along the first orientation, the movable side wall sections being movable along the first orientation independent all of the roof sections, the movable side wall sections being movable relative to the header of the fixed structural frame along the first orientation to convert the convertible side wall between the open configuration and the closed configuration, the side wall sections substantially overlapping one another when the convertible side wall is in the open configuration, and the movable side wall sections each having a height that extends from a ground surface to the header of the fixed structural frame on which the roof sections are supported.

* * * * *